US006223665B1

(12) United States Patent
Hindsley

(10) Patent No.: US 6,223,665 B1
(45) Date of Patent: May 1, 2001

(54) QUILT CLAMP

(76) Inventor: Lora L. Hindsley, 1336 Swallow Dr., Raleigh, NC (US) 27606

( * ) Notice: Subject to any disclaimer, the term of this patent is extended or adjusted under 35 U.S.C. 154(b) by 0 days.

(21) Appl. No.: 09/499,775

(22) Filed: Feb. 8, 2000

(51) Int. Cl.[7] ..... D05B 11/00; D05B 39/00; D05C 1/02

(52) U.S. Cl. ..... 112/117; 38/102.91

(58) Field of Search ..... 38/102.1, 102, 38/102.2, 102.91; 112/103, 117; 223/90, 91, 93, 96; 24/67.3, 67.5, 67.9, 507, 531, 545, 556, DIG. 22, DIG. 9, 557

(56) References Cited

U.S. PATENT DOCUMENTS

| | | | | |
|---|---|---|---|---|
| 522,991 | * | 7/1894 | Laubin | 38/102 |
| 1,329,411 | | 2/1920 | Kanta et al. . | |
| 1,675,609 | | 7/1928 | Kelley . | |
| 1,937,491 | * | 1/1933 | May | 112/117 |
| 2,279,628 | * | 4/1942 | Marsack | 112/117 |
| 3,044,426 | | 7/1962 | Schwarzberger . | |
| 4,702,184 | | 10/1987 | Datlof . | |
| 5,082,153 | * | 1/1992 | Duester et al. | 223/90 X |
| 5,103,747 | | 4/1992 | Resta et al. . | |
| 5,361,948 | * | 11/1994 | Batts | 223/91 X |
| 5,402,558 | * | 4/1995 | Santapa | 24/557 X |
| 5,711,236 | | 1/1998 | Badger . | |

* cited by examiner

*Primary Examiner*—Ismael Izaguirre
(74) *Attorney, Agent, or Firm*—Joseph N. Breaux

(57) ABSTRACT

A clamp for use in quilting that includes a top and a bottom quilt clamp portion that are forced together by a pair of springs to hold multiple layer of quilting materials, such as fabric and batting, firmly together while stitching the quilt pattern. To facilitate movement of the multiple layers in the desired quilt pattern, the quilt clamp is provided with a handle. The bottom surface of the quilt clamp is covered with felt to enhance the slidableness of the clamp on quilting tables and sewing machines.

2 Claims, 2 Drawing Sheets

QUILT CLAMP

TECHNICAL FIELD

The present invention relates to sewing accessories and more particularly to a quilt clamp for securely clamping and holding multiple layers of material together for quilting that includes a plastic clamp body, a clamp handle, two spaced resilient clamping teeth, and two clamp springs; the plastic clamp body including a top clamp portion integrally formed with and hingedly connected to a bottom clamp portion with a flexible plastic hinge portion; the bottom clamp portion having a bottom surface covered with a felt material and two spaced bottom clamp spring receiving channels formed between the bottom surface and the felt material; the top clamp portion having two spaced clamp spring guide channels each terminating in a clamp spring end portion receiving depression, two spaced clamping teeth attachment channels each having a T-shaped channel running the length of the top clamp portion for receiving a T-shaped channel insertion portion of one of the two resilient clamping teeth; each of the clamp springs having a straight bottom spring portion slidably positioned in one of the two bottom clamp spring receiving channels of the bottom clamp portion, a curved spring portion shaped to contact the back edges of the top and bottom clamp portions and a top clamp spring portion having a clamp spring end portion having an inwardly curled portion positioned closer to the straight bottom spring portion than the remainder of the top clamp spring portion; the top and bottom clamp portions defining a fabric receiving gap between an inside top clamp portion surface and an inside bottom clamp portion surface; the clamp handle being permanently affixed to the top clamp portion between the two spaced clamp spring guide channels and including a curved finger grip portion.

BACKGROUND ART

Quilting requires the quilter to hold multiple layers of quilting materials such as fabric and batting firmly together while stitching the quilt pattern. This can be difficult when the quilter has only an inch or so of quilting material to grasp or when the quilter suffers from hand or wrist disabilities such as arthritis or carpal tunnel syndrome. It would be desirable, therefore, to have a quilt clamp that could hold the multiple layers of quilting material firmly together freeing the quilter to concentrate on quilting the layers together. Because it can be difficult to move the multiple quilting material layers in the desired pattern when there is only an edge to grasp, it would also be desirable to have a quilt clamp that had a handle which could be grasped by the quilter to allow the user to easily move the multiple layers of quilt material in the desired quilt pattern.

GENERAL SUMMARY DISCUSSION OF INVENTION

It is thus an object of the invention to provide a quilt clamp that includes a plastic clamp body, a clamp handle, two spaced resilient clamping teeth, and two clamp springs; the plastic clamp body including a top clamp portion integrally formed with and hingedly connected to a bottom clamp portion with a flexible plastic hinge portion; the bottom clamp portion having a bottom surface covered with a felt material and two spaced bottom clamp spring receiving channels formed between the bottom surface and the felt material; the top clamp portion having two spaced clamp spring guide channels each terminating in a clamp spring end portion receiving depression, two spaced clamping teeth attachment channels each having a T-shaped channel running the length of the top clamp portion for receiving a T-shaped channel insertion portion of one or the two resilient clamping teeth; each of the clamp springs having a straight bottom spring portion slidably positioned in one of the two bottom clamp spring receiving channels of the bottom clamp portion, a curved spring portion shaped to contact the back edges of the top and bottom clamp portions and a top clamp spring portion having a clamp spring end portion having an inwardly curled portion positioned closer to the straight bottom spring portion than the remainder of the top clamp spring portion; the top and bottom clamp portions defining a fabric receiving gap between an inside top clamp portion surface and an inside bottom clamp portion surface; the clamp handle being permanently affixed to the top clamp portion between the two spaced clamp spring guide channels and including a curved finger grip portion.

It is a still further object of the invention to provide a quilting method that includes the steps of a) providing a quilt clamp that includes a plastic clamp body, a clamp handle, two spaced resilient clamping teeth, and two clamp springs; the plastic clamp body including a top clamp portion integrally formed with and hingedly connected to a bottom clamp portion with a flexible plastic hinge portion; the bottom clamp portion having a bottom surface covered with a felt material and two spaced bottom clamp spring receiving channels formed between the bottom surface and the felt material; the top clamp portion having two spaced clamp spring guide channels each terminating in a clamp spring end portion receiving depression, two spaced clamping teeth attachment channels each having a T-shaped channel running the length of the top clamp portion for receiving a T-shaped channel insertion portion of one of the two resilient clamping teeth; each of the clamp springs having a straight bottom spring portion slidably positioned in one of the two bottom clamp spring receiving channels of the bottom clamp portion, a curved spring portion shaped to contact the back edges of the top and bottom clamp portions and a top clamp spring portion having a clamp spring end portion having an inwardly curled portion positioned closer to the straight bottom spring portion than the remainder of the top clamp spring portion; the top and bottom clamp portions defining a fabric receiving gap between an inside top clamp portion surface and an inside bottom clamp portion surface; the clamp handle being permanently affixed to the top clamp portion between the two spaced clamp spring guide channels and including a curved finger grip portion; b) positioning portions of multiple material layers to be quilted between the top and bottom clamp portions and positioning the inwardly curled portion of each clamp spring end portion into a respective clamp spring end portion receiving depression; and c) quilting the multiple material layers by grasping the clamp handle and moving the multiple material layers in the desired pattern.

Accordingly, a quilt clamp and a quilting method are provided. The quilt clamp includes a plastic clamp body, a clamp handle, two spaced resilient clamping teeth, and two clamp springs; the plastic clamp body including a top clamp portion integrally formed with and hingedly connected to a bottom clamp portion with a flexible plastic hinge portion; the bottom clamp portion having a bottom surface covered with a felt material and two spaced bottom clamp spring receiving channels formed between the bottom surface and the felt material; the top clamp portion having two spaced clamp spring guide channels each terminating in a clamp spring end portion receiving depression, two spaced clamping teeth attachment channels each having a T-shaped channel running the length of the top clamp portion for receiving a T-shaped channel insertion portion of one of the two resilient clamping teeth; each of the clamp springs having a straight bottom spring portion slidably positioned in one of the two bottom clamp spring receiving channels of the bottom clamp portion, a curved spring portion shaped to contact the back edges of the top and bottom clamp portions and a top clamp spring portion having a clamp spring end portion having an inwardly curled portion positioned closer to the straight bottom spring portion than the remainder of the top clamp spring portion; the top and bottom clamp portions defining a fabric receiving gap between an inside top clamp portion surface and an inside bottom clamp portion surface; the clamp handle being permanently affixed to the top clamp portion between the two spaced clamp spring guide channels and including a curved finger grip portion.

The quilting method includes the steps of a) providing a quilt clamp hat includes a plastic clamp body, a clamp handle, two spaced resilient clamping teeth, and two clamp springs; the plastic clamp body including a top clamp portion integrally formed with and hingedly connected to a bottom clamp portion with a flexible plastic hinge portion; the bottom clamp portion having a bottom surface covered with a felt material and two spaced bottom clamp spring receiving channels formed between the bottom surface and the felt material; the top clamp portion having two spaced clamp spring guide channels each terminating in a clamp spring end portion receiving depression, two spaced clamping teeth attachment channels each having a T-shaped channel running the length of the top clamp portion for receiving a T-shaped channel insertion portion of one of the two resilient clamping teeth; each of the clamp springs having a straight bottom spring portion slidably positioned in one of the two bottom clamp spring receiving channels of the bottom clamp portion, a curved spring portion shaped to contact the back edges of the top and bottom clamp portions and a top clamp spring portion having a clamp spring end portion having an inwardly curled portion positioned closer to the straight bottom spring portion than the remainder of the top clamp spring portion; the top and bottom clamp portions defining a fabric receiving gap between an inside top clamp portion surface and an inside bottom clamp portion surface; the clamp handle being permanently affixed to the top clamp portion between the two spaced clamp spring guide channels and including a curved finger grip portion; b) positioning portions of multiple material layers to be quilted between the top and bottom clamp portions and positioning the inwardly curled portion of each clamp spring end portion into a respective clamp spring end portion receiving depression; and c) quilting the multiple material layers by grasping the clamp handle and moving the multiple material layers in the desired quilting pattern.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
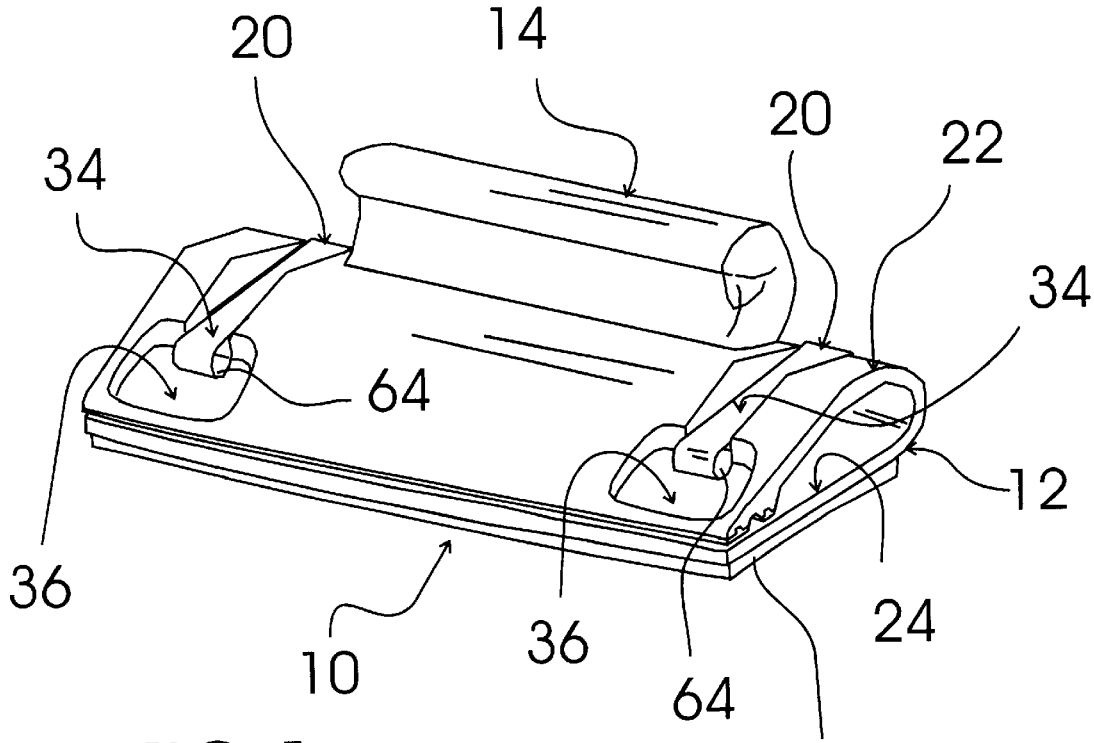
FIG. 1 is a perspective view of an exemplary embodiment of the quilt clamp of the present invention showing the plastic clamp body, the clamp handle, the two spaced resilient clamping teeth, and two clamp springs; the plastic clamp body including a top clamp portion integrally formed with and hingedly connected to a bottom clamp portion with a flexible plastic hinge portion; the bottom clamp portion having a bottom surface covered with a felt material and two spaced bottom clamp spring receiving channels formed between the bottom surface and the felt material; the top clamp portion having two spaced clamp spring guide channels each terminating in a clamp spring end portion receiving depression, two spaced clamping teeth attachment channels each having a T-shaped channel running the length of the top clamp portion for receiving a T-shaped channel insertion portion of one of the two resilient clamping teeth; each of the clamp springs having a straight bottom spring portion slidably positioned in one of the two bottom clamp spring receiving channels of the bottom clamp portion, a curved spring portion shaped to contact the back edges of the top and bottom clamp portions and a top clamp spring portion having a clamp spring end portion having an inwardly curled portion positioned closer to the straight bottom spring portion than the remainder of the top clamp spring portion; the top and bottom clamp portions defining a fabric receiving gap between an inside top clamp portion surface and an inside bottom clamp portion surface; the clamp handle being permanently affixed to the top clamp portion between the two spaced clamp spring guide channels and including a curved finger grip portion.
Figure 2:
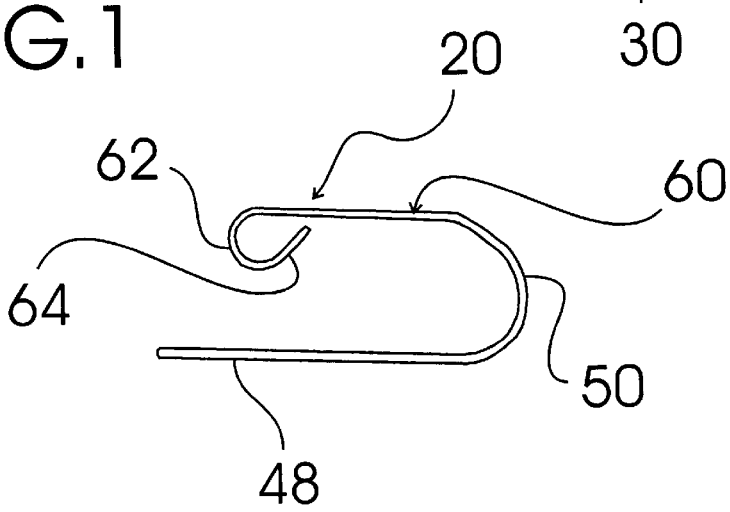
FIG. 2 is a side plan view of one of the two identical clamp springs.
Figure 3:
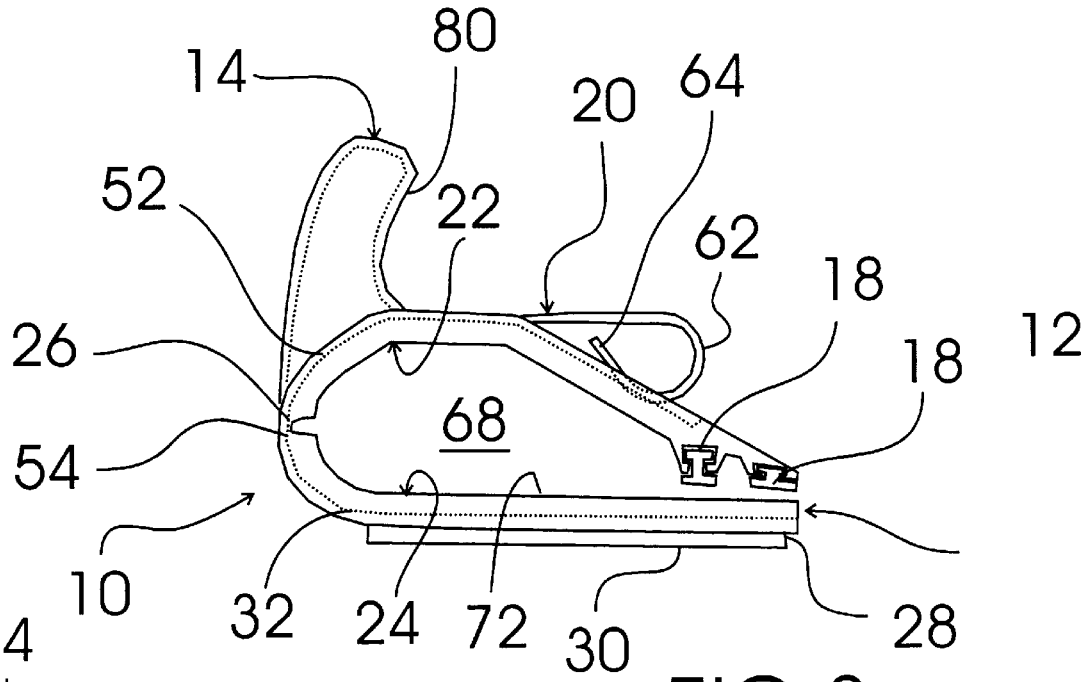
FIG. 3 is a side plan view of the quilt clamp of FIG. 1 showing one of the two clamp spring guide channels and one of the two bottom clamp spring receiving channels in dashed lines.
Figure 4:
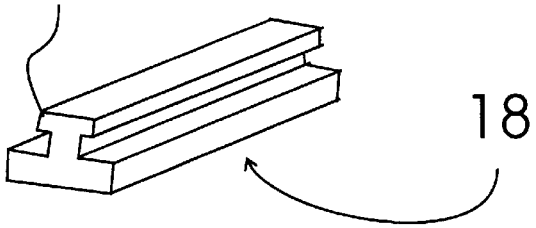
FIG. 4 is a perspective view of one of the two resilient clamping teeth in isolation.
Figure 5:
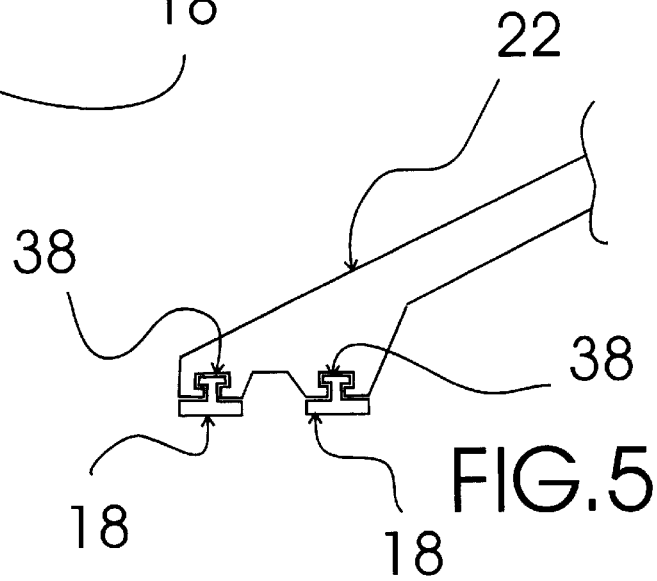
FIG. 5 is a detail side plan view of the front edge of the top clamp portion showing the two resilient clamping teeth slidably positioned into the two spaced clamping teeth attachment channels.

FIGS. 1–6 show various aspects of an exemplary quilt clamp of the present invention generally designated 10. Quilt clamp 10 includes a plastic clamp body, generally designated 12; a clamp handle, generally designated 14; two spaced resilient clamping teeth, each generally designated 18; and two clamp springs, each generally designated 20.

Plastic clamp body 12 is of molded plastic construction and includes a top clamp portion, generally designated 22, integrally formed with and hingedly connected to a bottom clamp portion, generally designated 24, with a flexible plastic hinge portion 26. Bottom clamp portion 24 has a bottom surface 28 covered with felt material 30 and two spaced bottom clamp spring receiving channels 32 (shown in dashed lines FIG. 3) formed between bottom surface 28 and felt material 30. Felt material 30 is provided to allow quilting clamp 10 to slide easily on quilting tables and sewing machine tops.

Top clamp portion 22 has two spaced clamp spring guide channels, generally designated 34, each terminating in a clamp spring end portion receiving depression 36, two spaced, T-shaped, clamping teeth attachment channels, generally designated 38, running the length of top clamp portion 22 for receiving a T-shaped channel insertion portion, generally designated 44, of one of the two resilient clamping teeth 18. Each of the clamp springs 20 is constructed of spring steel and has a straight bottom spring portion 48 slidably positioned in one of the two bottom clamp spring receiving channels 32 of bottom clamp portion 24; a curved spring portion 50 shaped to contact the back edges 52,54 of top and bottom clamp portions 22,24; and a top clamp spring portion, generally designated 60 having a clamp spring end portion 62 having an inwardly curled portion 64 positioned closer to the straight bottom spring portion 48 than the remainder of the top clamp spring portion 60. Top and bottom clamp portions 22,24 define a fabric receiving gap 68 between an inside top clamp portion surface 70 and an inside bottom clamp portion surface 72. In this embodiment, clamp handle 14 is permanently affixed to top clamp portion 22 between the two spaced clamp spring guide channels 34 by thermal welding and includes a curved finger grip portion 80.

An exemplary quilting method of the invention includes the steps of: a) providing a quilt clamp 10 as previously described; b) positioning portions of multiple material layers to be quilted between within gap 68 between top and bottom clamp portions 22,24 and positioning the inwardly curled portion 64 of each clamp spring end portion 62 into a respective clamp spring end portion receiving depression 36 such that the two spaced resilient clamping teeth 18 grip and hold the multiple material layers; and c) quilting the multiple material layers by grasping the clamp handle 14 and moving the multiple material layers in the desired quilting pattern.

It can be seen from the preceding description that a quilt clamp and quilting method have been provided.

It is noted that the embodiment of the quilt clamp described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A quilt clamp comprising:

a plastic clamp body;

a clamp handle;

two spaced resilient clamping teeth; and two clamp springs;

said plastic clamp body including a top clamp portion integrally formed with and hingedly connected to a bottom clamp portion with a flexible plastic hinge portion;

said bottom clamp portion having a bottom surface covered with a felt material and two spaced bottom clamp spring receiving channels formed between said bottom surface and said felt material;

said top clamp portion having two spaced clamp spring guide channels each terminating in a clamp spring end portion receiving depression, two spaced clamping teeth attachment channels each having a T-shaped channel running said length of said top clamp portion for receiving a T-shaped channel insertion portion of one of said two resilient clamping teeth;

each of said clamp springs having a straight bottom spring portion slidably positioned in one of said two bottom clamp spring receiving channels of said bottom clamp portion, a curved spring portion shaped to contact said back edges of said top and bottom clamp portions and a top clamp spring portion having a clamp spring end portion having an inwardly curled portion positioned closer to said straight bottom spring portion than said remainder of said top clamp spring portion;

said top and bottom clamp portions defining a fabric receiving gap between an inside top clamp portion surface and an inside bottom clamp portion surface;

said clamp handle being permanently affixed to said top clamp portion between said two spaced clamp spring guide channels and including a curved finger grip portion.

2. A quilting method comprising the steps of:

a) providing a quilt clamp that includes:

a plastic clamp body, a clamp handle, two spaced resilient clamping teeth, and two clamp springs;

said plastic clamp body including a top clamp portion integrally formed with and hingedly connected to a bottom clamp portion with a flexible plastic hinge portion;

said bottom clamp portion having a bottom surface covered with a felt material and two spaced bottom clamp spring receiving channels formed between said bottom surface and said felt material;

said top clamp portion having two spaced clamp spring guide channels each terminating in a clamp spring end portion receiving depression, two spaced clamping teeth attachment channels each having a T-shaped channel running said length of said top clamp portion for receiving a T-shaped channel insertion portion of one of said two resilient clamping teeth;

each of said clamp springs having a straight bottom spring portion slidably positioned in one of said two bottom clamp spring receiving channels of said bottom clamp portion, a curved spring portion shaped to contact said back edges of said top and bottom clamp portions and a top clamp spring portion having a clamp spring end portion having an inwardly curled portion positioned closer to said straight bottom spring portion than said remainder of said top clamp spring portion;

said top and bottom clamp portions defining a fabric receiving gap between an inside top clamp portion surface and an inside bottom clamp portion surface;

said clamp handle being permanently affixed to said top clamp portion between said two spaced clamp spring guide channels and including a curved finger grip portion;

b) positioning portions of multiple material layers to be quilted between said top and bottom clamp portions and positioning said inwardly curled portion of each clamp spring end portion into a respective clamp spring end portion receiving depression; and c) quilting the multiple material layers by grasping said clamp handle and moving the multiple material layers in a desired quilting pattern.

* * * * *